US005375809A

United States Patent [19]

Goto

[11] Patent Number: 5,375,809

[45] Date of Patent: Dec. 27, 1994

[54] ASSEMBLY FOR FORMING A POURED CONCRETE WALL CONSTRUCTION

[75] Inventor: Masahiro Goto, Tokyo, Japan

[73] Assignee: Wallace I. Stenzel, Milwaukee, Wis.

[21] Appl. No.: 907,389

[22] Filed: Jul. 1, 1992

[51] Int. Cl.[5] ..... E04G 9/10; E04G 17/065

[52] U.S. Cl. ..... 249/16; 52/314; 52/389; 249/93; 249/210; 249/213

[58] Field of Search ..... 249/16, 83, 91, 93, 249/94, 219.1, 219.2, 213, 210; 52/314, 389

[56] References Cited

U.S. PATENT DOCUMENTS

| | | | |
|---|---|---|---|
| 830,747 | 9/1906 | Stauffer | 249/16 |
| 946,731 | 1/1910 | Pedrick | 249/16 |
| 1,193,484 | 8/1916 | Ellert | 249/16 |
| 1,809,504 | 6/1931 | Carvel | 249/16 |
| 1,841,074 | 1/1932 | Wolff | 249/16 |
| 2,627,100 | 2/1953 | Jelks | 249/16 |
| 4,643,388 | 2/1987 | Tazawa | 249/219.2 |

*Primary Examiner*—James P. Mackey
*Attorney, Agent, or Firm*—Andrus, Sceales, Starke & Sawall

[57] ABSTRACT

A poured concrete wall construction. In forming the wall construction, a back panel is mounted on a foundation and a plurality of generally rectangular thin-walled blocks formed of crushed stone bonded with a thermosetting resin are stacked to form a wall that is spaced from the back panel with a cavity being defined between the stack and the back panel. A tubular frame is positioned outwardly of the stack, and a plurality of connecting members connect the back panel and the frame and extend through mating notches in the edges of adjacent the blocks. Clamps are connected to the outer ends of the connecting members to connect the connecting members to the frame. Concrete is subsequently poured into the cavity between the backing panel and the block stock to form the wall construction with the stack of blocks forming an outer decorative face for the wall.

6 Claims, 3 Drawing Sheets

ASSEMBLY FOR FORMING A POURED CONCRETE WALL CONSTRUCTION

BACKGROUND OF THE INVENTION

Poured concrete is frequently used to form building walls, retaining walls, and other structural members. The traditional method of forming a poured concrete wall is to initially construct a pair of spaced, parallel reinforced forms, either of plywood or metal, and the concrete is then poured into the cavity or space between the forms. While the normal poured concrete wall is suitable for structural components, it lacks an attractive appearance when used for retaining walls, or the outer wall of buildings.

To provide a textured surface for a poured concrete wall and improve the appearance, it has been usual to line the inner surface of the form with patterns, so that the outer surface of the poured wall has a textured or patterned appearance. Frequently the textured surface is then painted or colored to provide it with a more natural tone. This method of forming textured surfaces on poured concrete walls is expensive, for it requires the application of the textured veneer pattern and can also require the application of paint, or coloring to the textured surface.

SUMMARY OF THE INVENTION

The invention is directed to a poured concrete wall construction having an outer attractive, textured surface. In forming the wall construction, a back panel, formed of plywood sheets or the like, is initially mounted on a foundation and a plurality of generally rectangular, thin walled blocks formed of crushed stone bonded by a thermosetting resin are stacked in tiers to form an outer wall that is spaced from the back panel, with a cavity defined therebetween.

A tubular frame is positioned outwardly of the stack of blocks and a plurality of connecting members which preferably take the form of rods, are connected between the back panel and the frame and extend through openings in the blocks. More specifically, the edges of adjacent blocks bordering horizontal joints are formed with mating recesses or notches which define the openings that receive the connecting rods. Wooden blocks are mounted on the rods and bear against the outer surfaces of the blocks and straddle the horizontal joints between tiers of blocks. Clamps are mounted on the outer ends of the rods and serve to connect the rods to the frame, thereby positioning the stack of blocks in fixed relation to the back panel.

Concrete is then poured into the cavity between the back panel and the stack of blocks to form the wall and the concrete will seal the joints between the blocks. After the concrete has cured, the outer frame is removed and separation bolts are removed through the openings in the blocks. The openings can then be filled with a suitable filler to complete the construction.

The invention can be used to form building walls, retaining walls, or other structural components. As the blocks are formed of crushed stone, the wall has the attractive appearance of natural stone. It is also contemplated that the invention can be employed to form a structure, such as a sound barrier for highways, in which a stack of blocks is located on opposite surfaces of the structure.

The blocks, being thin walled and formed of resin-bonded stone, are light in weight and can be readily handled by workmen. In addition, the blocks can be cut to size, mitered, drilled, or the like. As the blocks are non-porous, there is no leakage of concrete through the blocks as the concrete is poured.

With the invention, the stacked blocks are used both as a form for pouring the wall and a finish surface. This not only eliminates the need of a second form, but also simplifies set-up and disassembly of the equipment.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
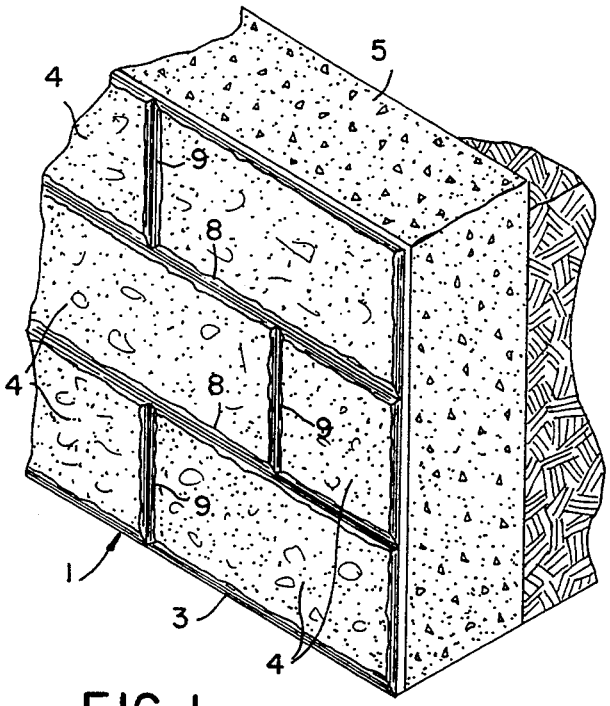
FIG. 1 is a perspective view of a wall constructed in accordance with the invention.
Figure 3:
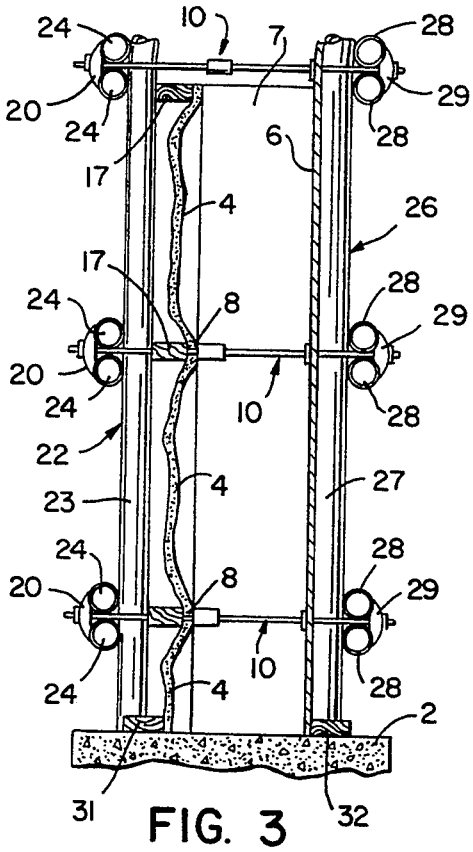
FIG. 3 is a vertical section of the construction shown in FIG. 2.

FIG. 1 shows a wall 1 that is constructed in accordance with the invention and can be utilized as a retaining wall, building wall, or other structural component. Wall 1 is supported on a foundation 2 and includes an outer textured surface 3 formed of a stack of thin walled blocks 4. A layer of concrete 5 is bonded to the rear surfaces of blocks 4 and provides structural strength for the wall The manner of forming the wall is illustrated in FIGS. 2–6. A series of back panels 6 are mounted on foundation 2, and the panels can take the form of plywood or metal sheets. Back panels 6 are spaced rearwardly from the stack of blocks 4, as shown in FIG. 3 to provide a cavity 7 therebetween, which is subsequently filled with the concrete 5.

Each block 4 is generally rectangular in configuration and is composed of crushed stone bonded by a thermosetting resin, such as an epoxy or polyester resin. The outer surface of the mold is roughened or textured to give the block the appearance of natural stone. Various colors of crushed stone can be employed to provide the wall with the desired color and appearance. The molded blocks 4 have a substantially uniform thickness throughout their area, with the thickness generally being in the range of about 1.0 to 1.3 cm.

As shown in FIG. 1, blocks 4 are stacked in a plurality of tiers, with horizontal joints 8 and vertical joints 9 between adjacent blocks.

The back panels 6 and stack of blocks 4 are connected together by a plurality of connecting assemblies 10. The connecting assemblies 10 are identical in construction and the construction of the connecting assembly is best illustrated in FIG. 4.

Figure 4:
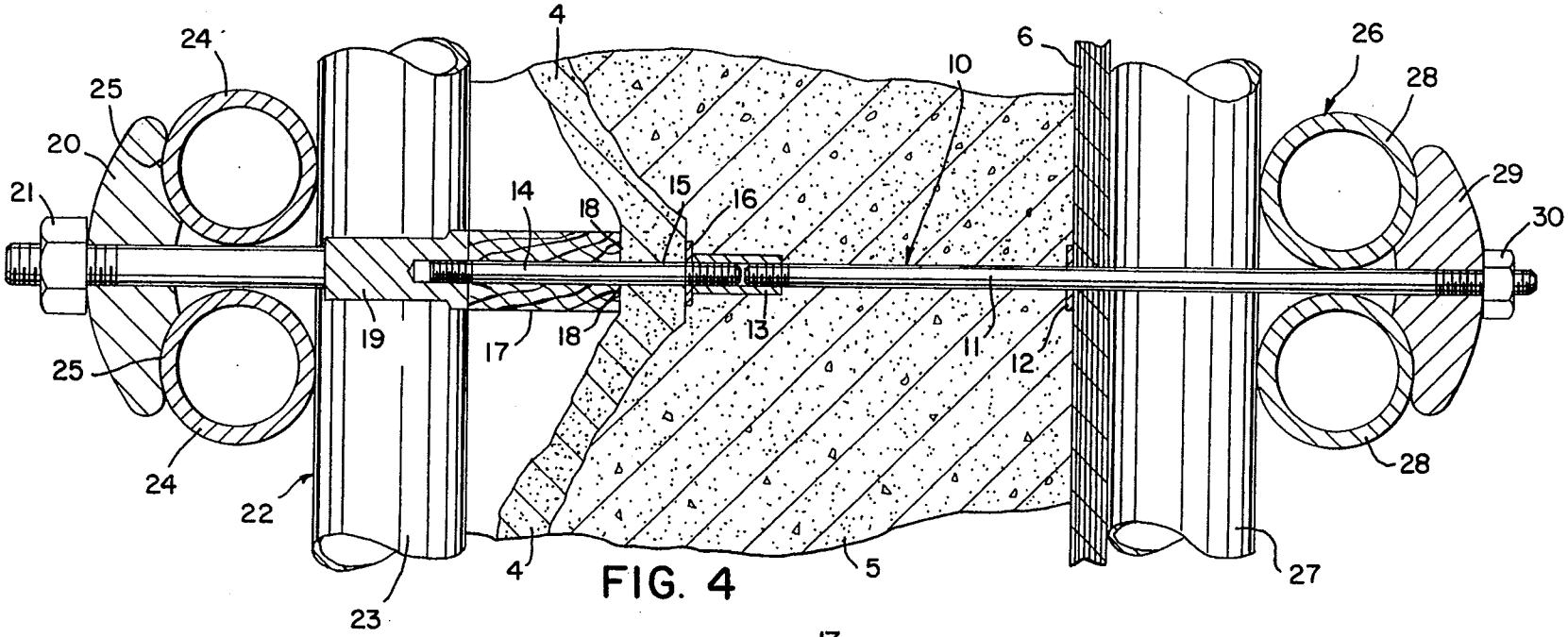
FIG. 4 is an enlarged vertical section showing the construction of the connectors.

Each connecting assembly 10 includes a rod or bolt 11 having an end that extends through an opening in back panel 6, and rod 11 carries a washer 12 which bears against the inner surface of panel 6, as shown in FIG. 4.

The opposite or inner end of rod 11 is threaded to a nut or turnbuckle 13, while a separation bolt 14 is threaded in the opposite end of the nut 13 and extends through a pair of mating recesses 15 which are located at a horizontal joint 8 between adjacent blocks 4. Each of the recesses 15 is generally semi-cylindrical in configuration and can be formed in the edge of the block by grinding or drilling.

As seen in FIG. 4, a washer 16 is interposed between the end of nut 13 and the inner surfaces of the blocks 4 and straddles the horizontal joint 8.

The outer end of bolt 14 extends through an opening or passage in a wood block 17, and the inner surface of block 17 bears against the generally flat peripheral edges 18 of blocks 4 adjacent the joint 8.

The outer end of bolt 14 is threaded within an opening in rod 19 and a clamp 20 is mounted on the outer end of rod 19 and is retained on the rod by a nut 21.

Figure 2:
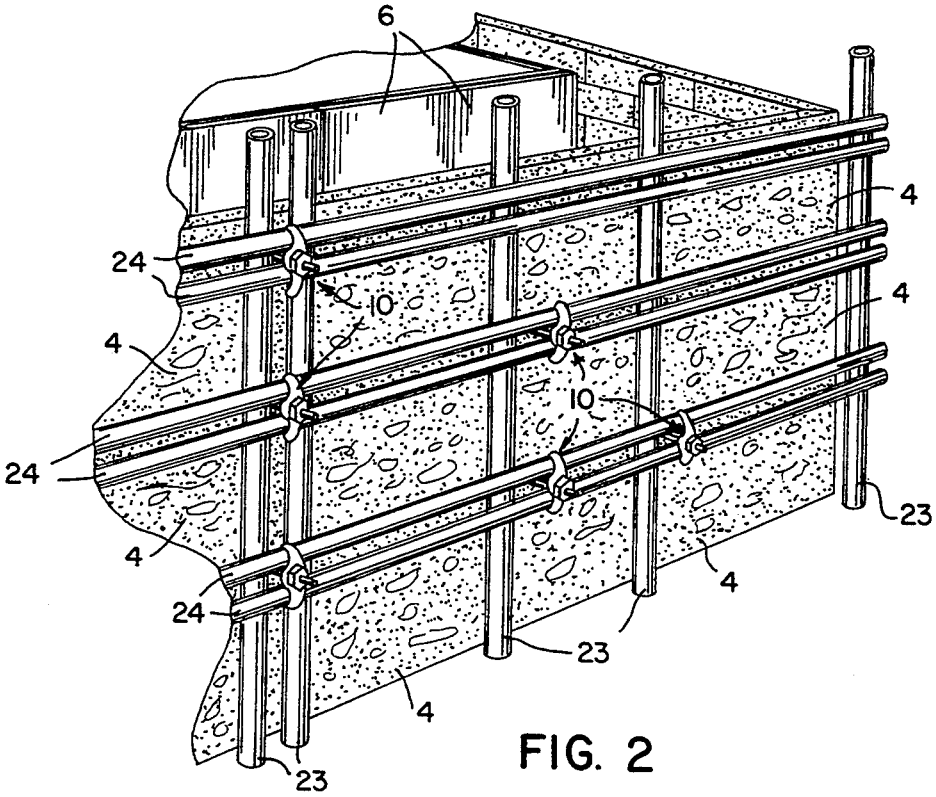
FIG. 2 is a perspective view of the forming assembly for the wall.

Clamps 20 serve to connect the connecting assemblies 10 to a tubular outer frame 22 which is located outward of the stack of blocks 4. Frame 22, as best seen in FIG. 2, includes a plurality of elongated vertical pipes 23 which can be engaged with the outer surfaces of blocks 17, as shown in FIG. 3, and a plurality of horizontal pipes 24, with each pair of pipes 24 straddling the rods 19. As shown in FIG. 4, the inner surface of each clamp 20 is provided with a pair of concave recesses 25 which are engaged with the horizontal pipes 24. By threading down nuts 21, clamps 20 will be moved into bearing engagement with the horizontal pipes 24 to thereby support the stack of blocks 4 in spaced relation relative to the back panels 6.

The opposite ends of the connecting assemblies 10 can also be connected to an inner frame 26, which is similar in construction to frame 22. Frame 26 includes a plurality of spaced elongated vertical pipes 27 which bear against the outer surface of back panels 6, and horizontal pipes 28 are positioned in contact with vertical pipes 27, as best shown in FIG. 3. Clamps 29, similar to clamps 20, are engaged with the horizontal pipes and nuts 30 are threaded on the ends of the rods 11. By threading down nuts 30, the back panels 6 will be firmly attached to the frame 26.

In forming the wall, a pair of boards 31 and 32 are initially mounted in spaced relation on foundation 2. The lower edges of back panels 6 are secured to one of the boards 31, while the lower edges of a tier of blocks 4 are attached to the opposite board 32, as shown in FIG. 3.

Figure 5:
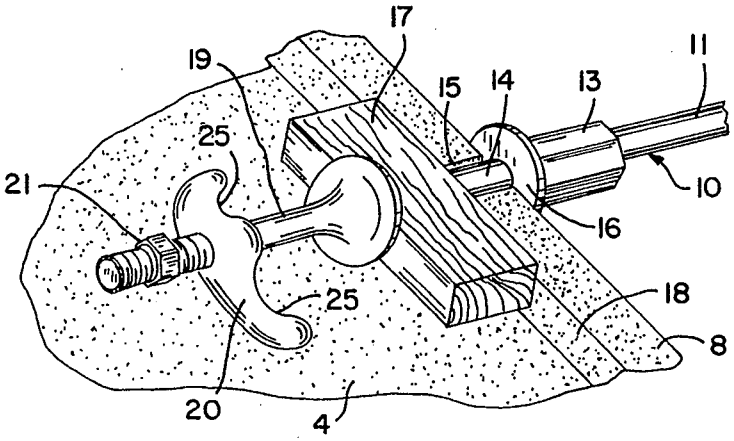
FIG. 5 is an enlarged perspective view showing the connection of the connecting rods and the blocks.

The connecting rods 11, with the attached separation bolts 14 and rods 19 are then attached to the back panels 6. As shown in FIG. 5, the separation bolts 14 are placed within the recesses 15 in the upper edges of a tier of blocks 4 and a second tier of blocks is then placed on the lowermost tier with the recesses 15 along the lower edges of the upper blocks receiving the separation bolts 14. Wood blocks 17 are then placed into contact with the peripheral edges 18 of the blocks 4, spanning the horizontal joint, as shown in FIG. 5. Rods 19 are then threaded down on the outer ends of the separation bolts 14 to thereby hold the stack of blocks 4 between clamping blocks 17 and washers 16.

After the blocks 4 have been stacked in the desired pattern to form the wall, the vertical and horizontal pipes of frames 22 and 26 are assembled and the clamps 20 are engaged with the horizontal pipes, as shown in FIG. 2. By threading down nuts 21, the connecting assemblies are securely mounted to the frames 22 and 26, thus positioning the stack of blocks 4 in spaced relation relative to the back panels 6.

Concrete can then be poured into the cavity 7 between back panels 6 and the stack of blocks 4. After curing of the concrete, the frames 22 and 26 can be disassembled, the rods 19 and clamping blocks 16 removed, and the separation bolts 14 can then be unthreaded. The holes resulting from removal of the separation bolts can be filled with the suitable filler which matches the color of the blocks 4.

Blocks 4 are formed of crushed stone and have a natural and attractive appearance. As the blocks 4 are of a thin wall construction, they are light in weight and can be easily handled. In addition, the blocks can be cut, beveled, mitered, or otherwise trimmed to form the desired contour of the wall. No sealant is required at the joints 8 and 9 for the concrete acts to fill the joints.

While the drawings illustrate the wall 1 being substantially vertical, it is contemplated that the wall can also be canted at an angle to the vertical. To provide the sloping or canted contour, tapered washers 16 are employed and the edge of the wooden clamping blocks 17 that bear against the blocks 4 are correspondingly tapered.

Figure 6:
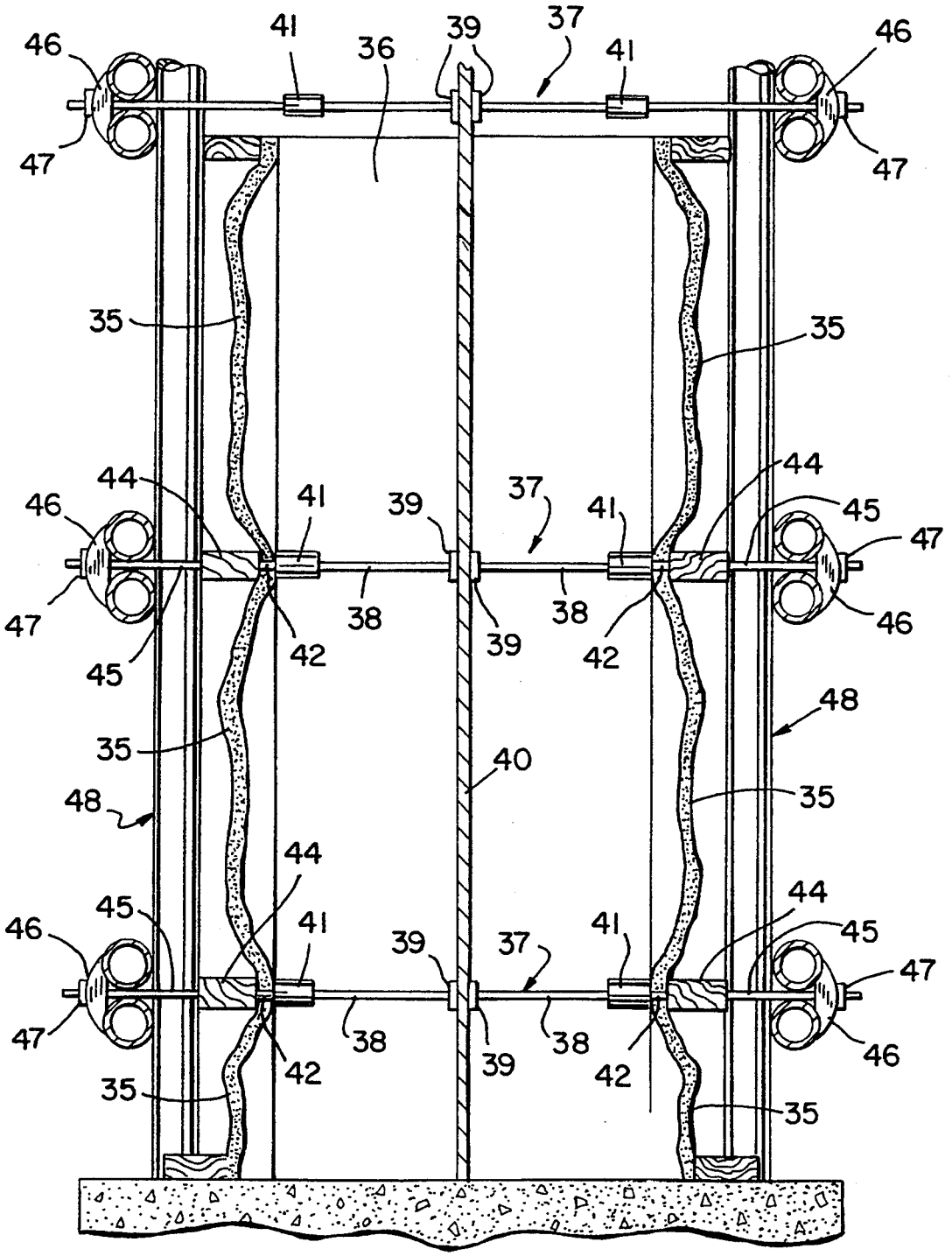
FIG. 6 is a vertical section of a modified form of the invention.

FIG. 6 illustrates a modified form of the invention in which the textured blocks or panels are located on both sides of the wall. The construction shown in FIG. 6 can be prefabricated and has particular use as sound barriers for highways, in which the wall sections are mounted in vertical guide channels.

The wall section includes a pair of spaced textured surfaces each formed of a stack of thin walled blocks 35 which are spaced apart to provide a cavity or space 36 therebetween. A mass of concrete is subsequently poured into the cavity to provide the completed wall section.

Blocks 35 are similar to blocks 4 of the first embodiment and are composed of crushed stone bonded by a thermosetting resin. As described in the first embodiment, the blocks 35 are stacked in a plurality of tiers with horizontal joints and vertical joints between adjacent blocks. The two stacks of blocks 35 are connected together by a plurality of connecting assemblies 37. Each connecting assembly includes a pair of axially aligned inner rods 38 and the inner ends of rods 38 are threaded within nuts 39 that are welded to a sheet of reinforcing mesh 40, which is located centrally of the cavity 36 between the stacks of blocks 35.

The outer end of each rod 38 is threaded to a turnbuckle 41 and a separation bolt 42, similar to bolt 14, is threaded in the opposite end of turnbuckle 41 and extends through a pair of mating recesses which are located at a horizontal joint between adjacent blocks 35, as previously described in the first embodiment. A suitable washer can be located between the end of turnbuckle 41 and the inner surfaces of the blocks 35 and straddles the horizontal joint between the blocks.

The outer end of each separation bolt 42 extends through an opening or passage in a wood block 44, similar to block 17, and the inner surface of the block bears against the flat peripheral edges of blocks 35 adjacent the horizontal joint. The outer end of separation bolt 42 is threaded within an opening in a rod 45 and a clamp 46 is mounted on the end of rod 45 and is retained on the rod by a nut 47.

As previously described, clamps 46 serve to connect the connecting assemblies 37 to tubular outer frames 48 which are located outwardly of each stack of blocks 35. Frames 48 are constructed similar to frames 22 of the first embodiment.

After assembly of the stacks of blocks 35 along with the connecting assemblies 37 and clamps 46, concrete is poured into the central cavity 36 between the stacks of blocks to form the wall section. The wall section has a textured surface on opposite sides and has particular use as a sound barrier for highways, in which the wall section is mounted within vertical guide channels. The wall sections can be pre-fabricated in various widths and heights, depending upon the requirements of use.

various modes of carrying out the invention are contemplated as being within the scope of the following claims particularly pointing out and distinctly claiming the subject matter which is regarded as the invention.

I claim:

1. An assembly for forming a poured concrete wall construction, comprising a plurality of blocks disposed in a generally vertical stack, said stack having a plurality of horizontal joints between adjacent tiers of said blocks, said stack having an inner face and an outer face, generally vertical backing means spaced from the inner face of said stack to define a cavity therebetween, and connecting means extending across said cavity for connecting said stack to said backing means, said connecting means including a first rod having a first end disposed adjacent said inner face and a second end secured to said backing means, a second rod axially aligned with said first rod and having a first end extending through an opening in said stack of blocks, said opening being disposed at a horizontal joint, turnbuckle means disposed in said cavity for connecting the first end of said first rod with said first end of said second rod, said turnbuckle means having an end surface straddling said horizontal joint and bearing against the inner face of said stack, a clamping block disposed against the outer face of said stack and straddling said joint, said clamping block having a passage to receive said second rod, a frame disposed outwardly of said outer face of said stack and engaged with said clamping block, and clamping means for clamping a second end of said second rod to said frame.

2. The assembly of claim 1, wherein said clamping means comprises a third rod axially aligned with said second rod, said third rod being connected to said second end of said second rod, said third rod having an end surface bearing against an outer face of said clamping block, said clamping means further including a clamping member disposed on an outer end of said third rod and engageable with said frame.

3. The assembly of claim 2, wherein said frame includes a pair of spaced parallel frame members, the outer end of said third rod extending between said frame members and said clamping member being engaged with said pair of frame members.

4. The assembly of claim 3, wherein said frame members are tubular and said clamping member includes a pair of concavities engaged with said pair of frame members.

5. The assembly of claim 1, wherein said backing means comprises a vertical panel, a second frame disposed outwardly of said panel, said first rod extending through an opening in said panel, and second clamping means engaged with the second end of said first rod for clamping the second end of said first rod to said second frame.

6. The assembly of claim 1, wherein each block is composed of crushed stone bonded by a thermosetting resin.

* * * * *